United States Patent [19]

Chaconas

[11] Patent Number: 5,056,386

[45] Date of Patent: Oct. 15, 1991

[54] SCREWDRIVER BIT AND FINDER SYSTEM

[75] Inventor: Peter C. Chaconas, Glyndon, Md.

[73] Assignee: Black & Decker Inc., Newark, Del.

[21] Appl. No.: 440,539

[22] Filed: Nov. 22, 1989

[51] Int. Cl.[5] ..... B25B 23/08

[52] U.S. Cl. ..... 81/451; 81/452

[58] Field of Search ..... 81/457, 451, 436, 52, 81/452

[56] References Cited

U.S. PATENT DOCUMENTS

| | | | |
|---|---|---|---|
| 1,708,766 | 4/1929 | Lochner . | |
| 2,698,637 | 1/1955 | Donovan | 81/451 |
| 2,782,823 | 2/1957 | Williams, Jr. . | |
| 3,392,767 | 7/1968 | Stillwagon, Jr. . | |
| 3,739,825 | 6/1973 | Knox | 81/451 |
| 4,221,249 | 9/1980 | Mazzeo et al. . | |
| 4,285,255 | 8/1981 | Winfrey . | |
| 4,287,923 | 9/1981 | Hornung . | |

FOREIGN PATENT DOCUMENTS

| | | |
|---|---|---|
| 187482 | 10/1956 | Austria . |
| OS 2117797 | 10/1972 | Fed. Rep. of Germany . |

*Primary Examiner*—James G. Smith
*Assistant Examiner*—Lawrence Cruz
*Attorney, Agent, or Firm*—Charles E. Yocum; Dennis A. Dearing; John D. Del Ponti

[57] ABSTRACT

The improved screwdriver bit and finder system of the present invention substantially aligns the axis of a screwdriver bit with the axis of a slotted-head fastener and maintains the alignment while the fastener is being driven. The inside diameter of a cylindrical finder and the diameter of a cylindrical driver portion and blade formed on an end of the bit are substantially matched in four different systems, with four discrete ranges of fastener head diameters. These matched systems of the present invention minimize the problems generated by conventional "one size fits all" bit and finders, namely, bit "wobble" in the finder and misalignment of the bit axis with the fastener axis, resulting in damaged bits and fasteners. In contrast, the axial alignment produced by the bit and finder system of the present invention minimizes the amount of driving force required and saves bits and fasteners from damage. The blade may be defined by a rectangular solid, the parameters of which are also selected to substantially match the slot size of the four discrete sizes of fasteners. Assembly of one embodiment of the bit and finder system of the present invention is quick and inexpensive, including the steps of forming the bit as a unitary structure drawing the finder into a cup-shaped cylinder, slipping it over the bit, sliding a coil spring over the bit and against the finder, and trapping the spring against the finder to bias the finder in the direction of the bit driver portion.

14 Claims, 2 Drawing Sheets

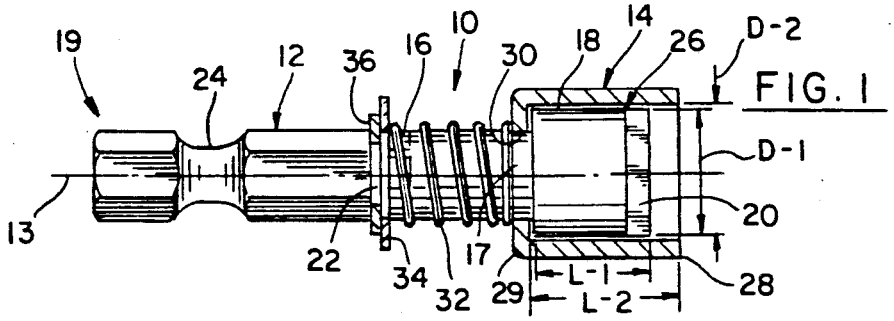
FIG. 1
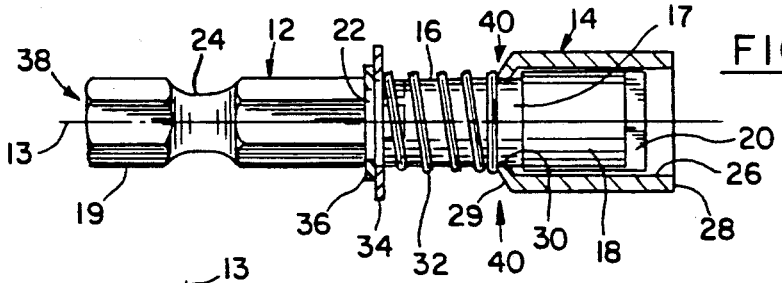
FIG. 2
FIG. 3
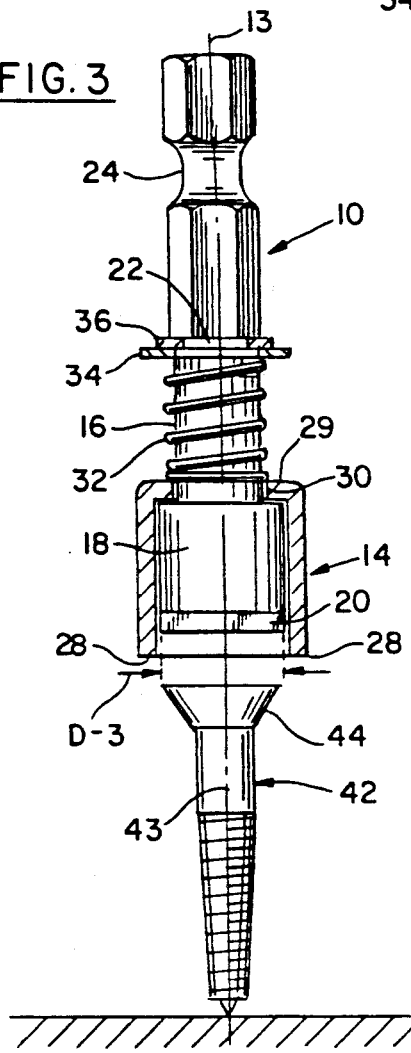
FIG. 4
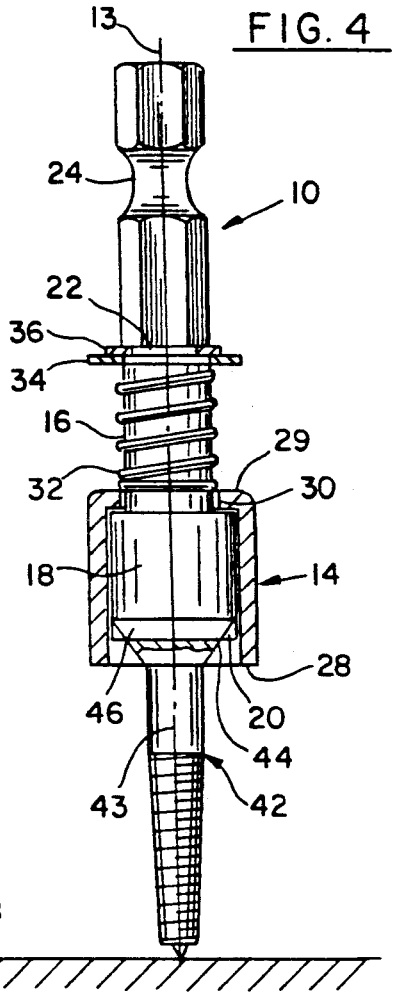

FIG. 5
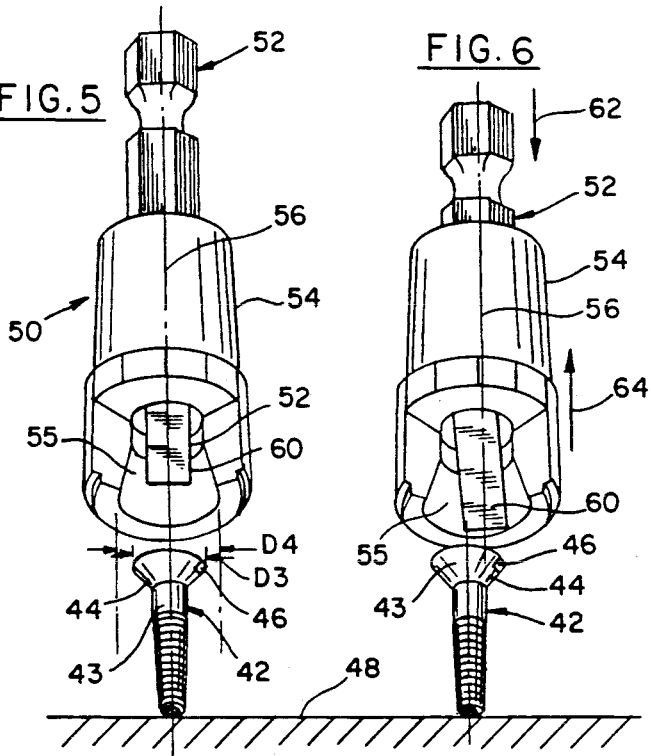
FIG. 6
FIG. 7
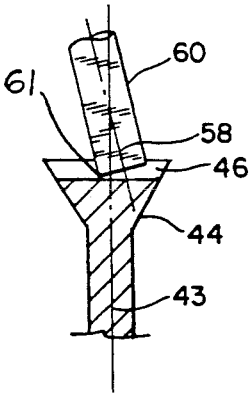
FIG. 8
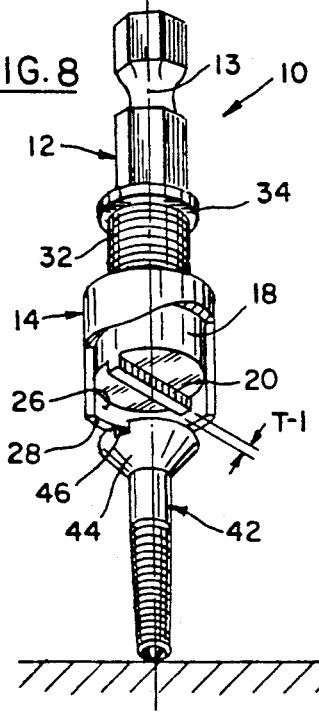
FIG. 9
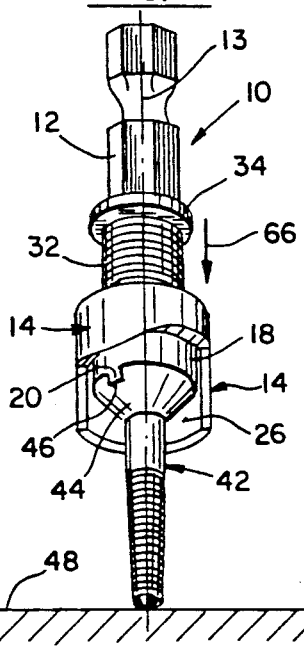
FIG. 10
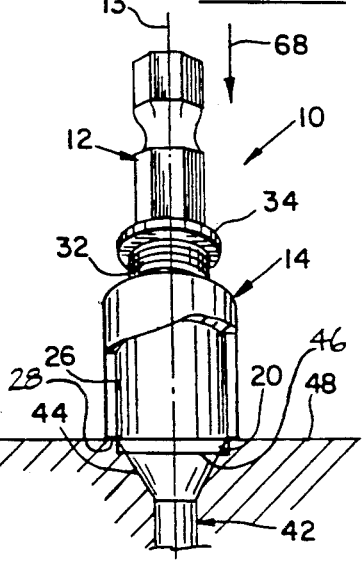

SCREWDRIVER BIT AND FINDER SYSTEM

FIELD OF THE INVENTION

This invention relates to an improved screwdriver bit and finder system, particularly for use with power-driven screwdrivers.

BACKGROUND OF THE INVENTION

It is known to provide a screwdriver bit and finder combination for attachment to power tools such as power screwdrivers. In one example of a conventional bit and finder, a bit is manufactured of hexagonal steel stock with the blade for driving a slotted-head fastener formed at one end, and an annular recess for engagement by the power screwdriver formed at the other end. The width of the blade is the same as the diameter of the bit. A cylindrical finder having an inside diameter considerably larger than the diameter of the bit is mounted on the bit shank. A coil spring is mounted over the bit between the shank and the inside surface of the finder. The spring is connected at one end to the bit shank and is trapped at its other end against a ledge formed on the inside surface of the finder.

The driving end of the finder is designed to "find" or locate slotted-head fasteners over a broad range of fastener head diameters. Also, the blade is formed with a chisel edge. In use, the operator pulls the finder back to expose the blade with one hand and then inserts the bit with the other hand into the screw recess. The operator then allows the finder to spring back to cover the head of the screw.

One of the inherent disadvantages of this conventional structure is that the large amount of clearance between the bit and the inside diameter of the finder permits the bit blade to wobble in two directions, both in a direction in the same plane as the blade, and from side to side in a direction transverse to the blade. This wobble means that the blade initially encounters the fastener head along an axis that is misaligned, or at an angle, to the axis of the fastener head. The result (as has been experienced by most users of screwdrivers), is that the blade contacts the fastener recess at an end point of the chisel, rather than along the entire edge or side face of the blade, mulilating the bit, the fastener or both.

This effect is magnified when the user attempts to drive a fastener that is accommodated by a "one size fits all" finder which in reality is much too large for the bit. In this situation, not only would the "wobble" effect occur, but, when a small bit, for example, a #6 bit, is used to drive a larger fastener (for example, a #8), there is far too little blade drive surface in engagement with the fastener head slot. Also, in view of the wobble effect, it is likely that the bit will engage the fastener recess at an angle to the fastener axis, when viewed in the plane of the blade. The mismatch of the blade width relative to the slot diameter of the fastener means that much more force must be exerted by the user to drive the fastener into a workpiece. This is analogous to a person who pushes a door at its center rather than near the knob, finding it much harder to open.

A converse mismatch occurs when, for example, the user desires to drive a #6 fastener with a #4 bit. The wobble effect increases the likelihood that the blade of the bit will be off-center or not fit the fastener recess, a condition which once again yields poor driving performance.

Accordingly, it can be seen that with this conventional bit and finder, the desire to accommodate fasteners having large ranges of head diameters with a single bit size is purchased at the cost of poor fastener driving performance, wasted time and mutilated bits and fasteners.

SUMMARY OF THE INVENTION

It is an object of the present invention to provide an improved bit and finder system which, by matching two parameters of the bit and finder system with, respectively, four major sizes of fastener heads, so that the longitudinal axis of the bit-finder system is aligned with the axis of the fastener head when the bit blade engages the fastener recess, and thereafter is maintained in alignment while the bit is driving the fastener. A feature by which this is achieved in preferred embodiments of the present invention is by forming a cylindrical driver portion with a uniform diameter on one end of the bit with a blade having a width equal to the diameter of the driving portion, and by placing a cylindrical finder having a uniform inside diameter in surrounding relation to the driver portion of the bit such that the respective diameters of the inside surface of the finder and the bit driver portion substantially match the diameter of the fastener head, whereby the bit, finder and fastener are forced into coaxial alignment.

A further feature includes a spring which is connected at one end to the shank of the bit and at the other end is trapped against the finder such that the finder is normally biased in the direction of the driver portion. This has the advantage of permitting the user to drive the fastener into the work surface such that an end face of the finder abuts the work surface, but which allows the blade to emerge from the finder to drive the fastener head flush with the work surface or, if desired, to countersink the fastener head.

Yet another preferred feature provides an inexpensive method for assembling the bit and finder system of the present invention. Cold rolled steel is drawn into the shape of an inverted cup to make the finder, such that the base of the cup defines an aperture which is slidably and rotatably engageable with the bit shank. The bit elements are also formed as a unitary structure; namely, the bit driver portion, a groove for retaining a snap ring or retainer member, and the annular groove for driving engagement with a power screwdriver are all formed from one piece of stock. The cup-shaped finder is slipped onto the bit such that the open end of the cup is facing the bit driver portion and is moved axially along the bit until the base of the cup engages the rear face of the driver portion. A coil spring is then slipped over the bit in the same manner until it engages the base of the finder; then a retaining member is placed onto the bit and moved against the spring until it traps it against the base of the finder. The retaining member is then connected to the shank of the bit.

Accordingly, therefore, there is provided by the present invention a screwdriver bit and finder system for driving a slotted-head fastener having an axis and a head diameter, such that the bit and finder are coaxially aligned with the axis of a fastener having a head diameter within a predetermined discrete range of head diameters. A screwdriver bit of the present invention includes a shank having a predetermined diameter, a first and second end, and defining a bit axis. A cylindrical driver portion is formed at the first end coaxial with the bit and having a predetermined length and a uniform predetermined outer diameter greater than the bit diameter, and including a driving end. A blade adapted to engage the slot of the fastener and centered on the driver portion driving end is formed such that it has a width equal to the driver portion outer diameter. A finder is slidably and rotatably mounted on the bit shank in overlying relation to the bit driver portion. It is defined by an inverted cup-shaped sleeve having a cylindrical inner guide surface of a predetermined length greater than the driver portion length, and a uniform predetermined inside diameter greater than the diameter of the fastener head. The sleeve includes a base defining an aperture of predetermined diameter such that the base is slidably and rotatably moveable on the shank. The bit and finder of the present invention includes means operatively associated with the bit shank and the finder for biasing the finder in a direction toward the bit shank first end. The diameters of the bit driver portion and the sleeve inner guide surface are selected from respective ranges of parameters such that the screwdriver bit axis is maintained in substantially coaxial alignment with the particular fastener axis upon engagement of the fastener by the blade, and thereafter while the bit is driving the fastener. The respective blades may be formed as rectangular solids, instead of chisel-edges, to match the sizes of slots formed in the respective discrete ranges of fastener heads. This structure prevents the blade from tilting transversely off the screw head, because the rectangular solid is backed up by the fastener slot width and the fastener head diameter. Other objects, features and advantages of the present invention will become more fully apparant from the following detailed description of the preferred embodiments, the appended claims and the accompanying drawings.

BRIEF DESCRIPTION OF THE DRAWINGS

In the accompanying drawings:

FIG. 1 is a side elevational view, partly in section, of one embodiment of the improved bit and finder system of the present invention;

FIG. 2 is a side elevational view, partly in section of another embodiment of the bit and finder system of the present invention;

FIG. 3 is a side elevational view, partly in section, of the embodiment shown in FIG. 1, poised above a slotted-head fastener;

FIG. 4 is a side elevational view, partly in section, of the embodiment shown in FIG. 1, in engagement with the fastener head, and with the bit, finder and fastener being in coaxial alignment;

FIG. 5 is a schematic perspective view, partialy cut away, of a conventional bit and finder poised over the head of an oversized fastener;

FIG. 6 is a schematic perspective view, partially cut away, of a conventional bit and finder with the finder being pulled back to expose the off-center bit in skewed relation to the axis of an oversized fastener.

FIG. 7 is an enlarged schematic view, somewhat exaggerated, showing the mismatch between the blade and bit of a conventional bit and finder as it engages the fastener head recess of the oversized fastener shown in FIG. 6;

FIG. 8 is a schematic perspective view, partially cut away, of the bit and finder of the present invention as shown in FIG. 1, poised above a slotted-head fastener;

FIG. 9 is a schematic perspective view, partially cut away and similar to FIG. 8, but showing the bit and finder of the present invention with the rectangular solid blade in engagement with the mating slot of the fastener head; and FIG. 10 is a schematic perspective view, partially cut away and similar to FIG. 9, in which the finder of the bit and finder of the present invention has been moved upwardly by engagement with the work surface against the bias of the spring so that the bit blade can drive the fastener either flush with or countersunk relative to the work surface.

DETAILED DESCRIPTION OF THE PREFERRED EMBODIMENT

FIGS. 1 and 2 show two embodiments of the bit and finder system of the present invention.

FIG. 1 shows one embodiment of the bit and finder system of the present invention, denoted generally as 10. A bit 12 may be formed as a unitary structure having its various features formed coaxial with a bit axis 13. A finder 14 is slidably and rotatably mounted on a shank 16 of the bit 12 at a shank first end 17. A driver portion 18 having a uniform diameter D-1 and a length L-1 is formed on the shank 16 adjacent the shank first end 17. A blade 20 is formed at one end of the driver portion 18. The blade 20 may be defined by a rectangular solid having the same width D-1 as that of the driver portion, a height H-1 and, as shown in FIG. 8, a thickness T-1. An annular drive groove 24 is formed adjacent a shank second end 19 so that the bit 12 may be inserted and driven by a conventional power tool such as a power screwdriver (not shown). Alternatively, the shank second end 19 may have any suitable configuration, and may be attachable to, or part of, a hand-powered screwdriver. Intermediate the first and second ends 17, 19 an annular retaining groove 22 is formed in the surface of the shank 16.

The finder 14 may be formed, for example, by drawing cold rolled drawing quality 1010 steel into the shape of a cylindrical cup having a first inside guide surface 26, an open end 28 and a base 29 defining a second inside guide surface 30, which is adapted to be slidably and rotatably moveable on bit shank 16. The cylindrical finder first inside guide surface 26 has a diameter D-2 greater than the driver portion diameter D-1, and an axial length L-2 greater than the axial length of the driver portion L-1. The respective relationships of these parameters will be defined later. To assemble the embodiment 10 shown in FIG. 1, the finder 14 is slipped onto the bit 12 and moved from the bit shank second end 19 in the direction of the bit shank first end 17 until the finder base 29 contacts the driver portion 18. Then a coil spring 32 having an inside diameter greater than the diameter of bit shank 16 is slipped onto the bit 12 from the shank second end 19, again in the direction of the shank first end 17 until the spring engages the base 29 of the finder. Then a washer 34 is slipped onto the shank 16 and is moved toward the shank first end 17 until it has passed the groove 22. A snap ring 36 is then connected to shank 16 at the groove 22, thereby trapping the coil spring 32 between the washer 34 and the finder 14. The distance between the snap ring 36 and the finder base 29 is selected to snuggly trap the spring 32. This process is appropriate for embodiments of the present invention in which the driver portion 18 has a diameter D-1 greater than the diameter of the bit shank 16.

FIG. 2 shows a second embodiment of the bit and finder system of the present invention, which is designated generally as 38. In this embodiment, the driver portion diameter D-1 is smaller than the bit shank diameter, and a different assembly procedure may be followed. The finder 14 may be made out of No. 17 gauge (0.058 inch) cold drawn seamless tubing, 0.375 inch O.D. The tubing is first cut to size and the finder or sleeve 14 is slipped over the bit driver portion 18 and over its base 29; the finder is then crimped into place as shown by arrows 40.

In each embodiment of the present invention shown in FIGS. 1 and 2, the bit driver portion is slidably and rotatably moveable within the finder 14. It can be appreciated that the washer 34 and snap ring 36 may be replaced by a single retaining member if desired.

Referring now to FIGS. 3 and 4, an important feature of the present invention is shown. In FIG. 3, the bit and finder system 10 of the present invention is shown poised above a threaded fastener 42 defining a fastener axis 43 and having a fastener head 44. The diameter of the fastener head, D-3, is substantially matched by the width of D-1 of the blade 20 and the diameter D-2 of the finder first inside guide surface 26. The parameters D-1 and D-2 are selected such that for a discrete range of fastener head diameters D-3, when the bit and finder system of the present invention engages the head 44 of the fastener such that the blade 20 is inserted in the fastener slot 46, the bit and finder axis 13 is coaxially aligned with the fastener axis 43. The alignment is maintained while the bit 12 drives the fastener 42. The parameters are, for example, established in four sets, one set for each size of a threaded fastener, so that a bit and finder system using a No. 6 bit can be used in conjunction with a No. 6 fastener; a bit and finder using a No. 8 bit can be used with a No. 8 fastener; and so forth for a desired number of bit and fastener sizes. In this way, the bit driver portion 18 can be guided along substantially the entire length L-2 of the finder first inside guide surface 26. This insures that the axes of the finder 14 and the bit blade 28 are congruent. This eliminates the "wobble" effect, a marked disadvantage of a conventional bit and finder. Furthermore, by selecting the driver portion and finder inside guide surface diameters D-1 and D-2, respectively, to substantially match the fastener head diameter D-3 which is within the range of diameters associated with a single fastener size, the bit and finder system axis 13 can now be maintained in substantial alignment with the fastener axis 43, as shown in FIG. 4.

These features of the bit and finder system 10 of the present invention are in marked contrast to the disadvantages suffered by a conventional bit and finder as shown generally at 50 in FIGS. 5 and 6. This bit and finder includes a bit 52 having a chisel blade 60 formed at one end having a width approximately equal to the bit diameter. A finder 54 is mounted in a rotatable and slidable fashion upon the bit 52. A spring (not shown) is fastened at one end to the bit 52 and is restrained at its other end by an internal feature of the finder 54. The spring is a coil spring mounted over the bit 52. The finder 54 defines a conical guide surface 55 which has an entrance diameter D-4 selected to be large enough to accommodate fasteners of several ranges of head diameters D-3, as is schematically shown in FIG. 5. In this example, a smaller fastener 42 was selected having a head 44 which defines a slot 46 and a fastener axis 43. The conventional finder's axis is shown at 56. In FIG. 6, the operator has pulled the finder back with one hand as shown by arrow 64 while engaging the fastener 42 with the other hand and pushing the bit toward the fastener as shown by arrow 62. At this point, it is possible for the head 44 of fastener 42 to engage the finder guide surface 55 at the left-hand end as shown in FIG. 6. This forces the conventional finder's axis 56 to be misaligned with the fastener axis 43, as shown also in FIG. 6. The condition shown in FIG. 6 is aggravated, as illustrated in FIG. 7 by the existence of wobble between the conventional bit and finder's internal guiding surface. As shown schematically in FIG. 7, the bit axis 58 is not only displaced from the fastener axis 43 but it is skewed at an angle, as a result of wobble. Consequently, one point 61 of the chisel blade 60 of the bit 52 engages the fastener recess 46, resulting in serious damage to the fastener, the bit, or both.

As previously noted, it may be desirable to form the blade 28 of the bit and finder system of the present invention in the shape of a rectangular solid. By matching the dimensions of the blade with those of the slot 46 of fastener 42, to a great degree, cam-out can be minimized, and the bit can be prevented from tilting transversely out of the slot, inasmuch as the bit recess and head coact to prevent the blade from tilting. This close fit is illustrated in FIG. 9.

Another feature of the present invention is shown in FIG. 10. The finder open end 28 is engagable with the work surface 48 so that the blade 20 may be extended from the finder 14, making it possible to drive the fastener 42 so that its head 44 is flush with the work surface 48, or if desired, to countersink the head of the fastener below the work surface 48. Upon retraction of the bit and finder of the present invention from the fastener, the spring 32 returns the finder to its original position shown in FIG. 8.

A Table of Parameters for the bit and finder system of the present invention which have been found to be effective for respective discrete fastener sizes (Nos. 6, 8, 10, 12) are listed as follows:

TABLE of Parameters

| Screw & Bit Size | Range of Fastener Head Dia. (D-3) | Blade Width (D-1) | Finder I.D. (D-2) | Blade Height (H-1) | Blade Thick. (T-1) |
|---|---|---|---|---|---|
| #6 | 0.240 to 0.279 in | 0.273 to 0.275 in | 0.280 to 0.285 in | 0.053 to 0.057 in | 0.036 to 0.038 in |
| #8 | 0.287 to 0.332 in | 0.327 to 0.329 in | 0.333 to 0.338 in | 0.061 to 0.065 in | 0.042 to 0.044 in |
| #10 | 0.334 to 0.385 in | 0.379 to 0.381 in | 0.386 to 0.391 in | 0.070 to 0.074 in | 0.047 to 0.049 in |
| #12 | 0.382 to 0.438 in | 0.432 to 0.434 in | 0.439 to 0.444 in | 0.078 to 0.082 in | 0.053 to 0.055 in |

The fastener head diameters were obtained from "Fastener Standards—Fifth Edition" (Fifth Printing, 1980), published by the Industrial Fasteners Institute, 1505 E. Ohio Building, Cleveland, Ohio 44104.

In the embodiment of the bit and finder system of the present invention shown in FIG. 1, the range of lengths L-2 of the finder first inside guide surface 26 has been found to be 0.440 inch to about 0.500 inch for bit and fasteners size Nos. 8, 10 and 12; the range of acceptable diameters for the finder second inside guide surface has been found to be 0.290 inch to 0.295 inch, for a bit diameter of 0.246 inch to 0.250 inch. The acceptable range of lengths L-2 for the embodiment 38 of the present invention shown in FIG. 2 is approximately the same as that of the embodiment shown in FIG. 1.

In both embodiments of the present invention shown in FIGS. 1 and 2, an acceptable range of lengths L-1 of the driver portion 18 has been found to be approximately 0.39 inch to 0.41 inch.

It is now possible, by virtue of the bit and finder systems 10, 38 of the present invention, to drive the fasteners with maximum efficiency and to minimize the damage to bits and fasteners frequently caused by the misalignment generated by "one size fits all" conventional bits and finders. In addition, the bit and finder system of the present invention is economical to manufacture, requiring a minimum of parts and assembly steps.

Although the preferred embodiments of the present invention have been described above in relation to their uses with a power tool, such as a power screwdriver, it will be appreciated that they can be used as attachments to, or as parts of, manually-driven screwdrivers.

The above described embodiments, of course, are not to be construed as limiting the breadth of the present invention. Modifications, and other alternative constructions, will be apparent which are within the spirit and scope of the invention as defined in the appended claims.

What is claimed is:

1. A screwdriver bit and finder system for driving a slotted-head fastener having an axis and a predetermined head diameter, comprising:

(a) a screwdriver bit including a shank having a first end and defining a bit axis;

(b) a finder having a predetermined length and a base slideably and rotatably coaxially mounted on said bit adjacent said first end;

(c) means operatively associated with said bit and finder for biasing said finder toward said first end to an extended position relative to said bit;

(d) alignment means for coaxially aligning said bit axis with said fastener axis and for maintaining said alignment thereafter while said bit drives said fastener;

(e) said alignment means including a driver portion having a predetermined length formed at said bit first end, and coaxial therewith, having an outer cylindrical surface of a uniform diameter along the entirety of said driver portion predetermined length, and having a blade formed thereon having a width equal to said driver portion uniform diameter, said blade width being sized to substantially match said fastener predetermined head diameter;

(f) said cylindrical driver portion being engageable with said finder base when said finder is biased in its extended position;

(g) said alignment means further including a first inside cylindrical guide surface defined by said finder and having a length substantially equal to said finder predetermined length and further having a predetermined uniform diameter sized to give a close fit with said fastener head upon insertion of said fastener head into said finder, said first cylindrical guide surface being coaxial with said bit driver portion and having an axial length greater than said predetermined length of said driver portion;

(h) said finder defining a second inside guide surface having a diameter less than the diameter of said first guide surface;

(i) said second inside guide surface rotatably and slideably engaging said bit shank; and (j) whereby said cylindrical driver portion is guided along substantially the entire length of said finder.

2. The system claimed in claim 1, wherein:

(a) said finder defining a cup having a closed end and an open end;

(b) said closed end defining said second inside guide surface; and (c) said cup being formed of drawn steel.

3. A screwdriver bit and finder system for driving a slotted-head fastener having an axis and a predetermined head diameter, comprising:

(a) a screwdriver bit including a shank having a first end and defining a bit axis;

(b) a finder having a predetermined length and a base slideably and rotatably mounted on said bit adjacent said first end;

(c) a retainer connected to said bit shank a predetermined distance from said finder;

(d) means operatively associated with said bit and finder for biasing said finder toward said first end to an extended portion relative to said bit;

(e) said means for biasing including a spring coiled around said bit shank and trapped between said retainer and said finder;

(f) alignment means for coaxially aligning said bit axis with said fastener axis and for maintaining said alignment thereafter while said bit drives said fastener;

(g) said alignment means including a driver portion having a predetermined length formed at said bit first end, and coaxial therewith, having an outer cylindrical surface of a uniform diameter along the entirety of said driver portion predetermined length, and having a blade formed thereon having a width equal to said driver portion uniform diameter, said blade width being sized to substantially match said fastener predetermined head diameter;

(h) said cylindrical driver portion being engageable with said finder base when said finder is biased in its extended position;

(i) said alignment means further including a first inside cylindrical guide surface defined by said finder and having a length substantially equal to said finder predetermined length and further having a predetermined uniform diameter sized to give a close fit with said fastener head upon insertion of said fastener head into said finder, said first cylindrical guide surface being coaxial with said bit driver portion and having an axial length greater than said predetermined length of said driver portion; and (j) whereby said cylindrical driver portion is guided along substantially the entire length of said finder.

4. The system claimed in claim 3, wherein:

(a) for slotted-head fasteners having head diameters in the range of 0.240 inch to 0.279 inch, said bit driver portion diameter being in the range of 0.273 inch to 0.275 inch; and (b) said first inside cylindrical guide surface having a diameter in the range of 0.280 inch to 0.285 inch.

5. The system claimed in claim 3, wherein:

(a) for slotted-head fasteners having head diameters in the range of 0.287 inch to 0.322 inch, said bit driver portion diameter being in the range of 0.327 inch to 0.329 inch; and (b) said first inside cylindrical guide surface having a diameter in the range of 0.333 inch to 0.338 inch.

6. The system claimed in claim 3, wherein:

(a) for slotted-head fasteners having head diameters in the range of 0.334 inch to 0.385 inch, said bit driver portion diameter being in the range of 0.379 inch to 0.381 inch; and (b) said first inside cylindrical guide surface having a diameter in the range of 0.386 inch to 0.391 inch.

7. The system claimed in claim 3, wherein:

(a) for slotted-head fasteners having head diameters in the range of 0.382 inch to 0.438 inch, said bit driver portion diameter being in the range of 0.432 inch to 0.3434 inch; and (b) said first inside cylindrical guide surface having a diameter in the range of 0.439 inch to 0.444 inch.

8. The system claimed in claim 3, wherein:

(a) said finder base having a predetermined thickness; and (b) said finder predetermined length being greater than said first inside cylindrical drive surface by an amount approximately equal to said finder base predetermined thickness.

9. The system claimed in claim 4, wherein said blade being defined by a rectangular solid having a height in the range of 0.053 inch to 0.057 inch and a thickness in the range of 0.036 inch to 0.038 inch.

10. The system claimed in claim 5, wherein said blade being defined by a rectangular solid having a height in the range of 0.061 inch to 0.065 inch and a thickness in the range of 0.042 inch to 0.044 inch.

11. The system claimed in claim 6, wherein said blade being defined by a rectangular solid having a height in the range of 0.070 inch to 0.074 inch and a thickness in the range of 0.047 inch to 0.049 inch.

12. The system claimed in claim 7, wherein said blade being defined by a rectangular solid having a height in the range of 0.078 inch to 0.082 inch and a thickness in the range of 0.053 inch to 0.055 inch.

13. The system claimed in claim 8, wherein:

(a) said finder being defined by a unitary cup-shaped cylinder having an open end and a closed end; and (b) said finder base being defined by said cylinder closed end.

14. A screwdriver bit and finder system for driving a slotted-head fastener having an axis and a head diameter lying within a predetermined range of head diameters, comprising:

(a) a screwdriver bit including shank having a predetermined diameter, a first end and a second end, and defining a bit axis;

(b) a cylindrical driver portion formed at said bit first end coaxial with said bit and having a predetermined length and a uniform predetermined diameter, and having a driving end;

(c) a blade adapted to engage the slot of said fastener and centered on said driver portion driving end, said blade further having a width equal to said driver portion outer diameter;

(d) a finder slideably and rotatably mounted on said bit shank in normally overlying relation to said bit driver portion;

(e) said finder being defined by a cup-shaped sleeve having a cylindrical inner guide surface of a predetermined length greater than said driver portion length and a uniform inside diameter greater than the diameter of said fastener head;

(f) said sleeve including a base defining an aperture of predetermined diameter such that said base is slideably and rotatably moveable on said shank;

(g) means external of said finder and operatively associated with said bit shank and said finder for biasing said finder in a direction toward said bit shank first end to an extended position;

(h) said sleeve base being operatively associated with said driver portion to limit the amount of extension of said finder relative to said driver, whereby said finder is not normally removeable from said bit by axially moving said finder in a direction toward said bit shank first end; and (i) said driver portion uniform predetermined outer diameter and said sleeve inner guide surface predetermined inside diameter being selected from respective ranges of parameters such that said screwdriver bit axis is maintained in substantially coaxial alignment with said fastener axis upon engagement of said fastener slot by said blade, and thereafter while said bit is driving said fastener.

* * * * *